United States Patent [19]

Warncke

[11] 4,154,235

[45] May 15, 1979

[54] ESCAPE FILTER DEVICE HAVING PROTECTIVE HOOD

[75] Inventor: Ernst Warncke, Lübeck, Fed. Rep. of Germany

[73] Assignee: Drägerwerk Aktiengesellschaft, Fed. Rep. of Germany

[21] Appl. No.: 830,065

[22] Filed: Sep. 2, 1977

[30] Foreign Application Priority Data

Sep. 2, 1976 [DE] Fed. Rep. of Germany ..... 2639545

[51] Int. Cl.[2] ..... A62B 7/10

[52] U.S. Cl. ..... 128/142.7; 128/142.6; 128/146.6

[58] Field of Search ..... 128/142.7, 145 R, 142.3, 128/142.4, 142.5, 142.6, 142.7, 141 R; 2/2 R, 2.1 R, 410, 5, 6, 7, 8, 417, 421, 424, 15, 9, 84, 202, 205

[56] References Cited

U.S. PATENT DOCUMENTS

| | | | |
|---|---|---|---|
| 472,048 | 4/1892 | Helbing | 128/142.7 X |
| 1,978,994 | 10/1934 | Fortunato | 128/142.7 X |
| 2,262,522 | 11/1941 | Yant et al. | 128/142.7 |
| 4,055,174 | 10/1977 | LeVasseur | 128/142.5 |

*Primary Examiner*—Henry J. Recla
*Attorney, Agent, or Firm*—McGlew and Tuttle

[57] ABSTRACT

An escape filter device for engagement over the head of a wearer, comprises a protective hood made of a transparent foil, such as, a plastic material. The hood has an opening in the front which aligns with the mouth of the wearer into which a mouthpiece of a filter is attached. The filter has means for purifying the incoming air which is inhaled into the mouth and exhaled out of the mouth directly through passages defined in the filter. The hood includes a nose piece of resilient material which projects inside of the hood against the face of the wearer beneath the nose and over the upper lip. This nose piece may be compressed to engage it tightly against the nose to prevent breathing of any air which enters into the hood by tightening a strap which engages around the jaw and neck of the wearer and may be fastened at the rear of the hood. An additional chin strap or strap fitting below the chin against the neck may be provided.

6 Claims, 2 Drawing Figures

ESCAPE FILTER DEVICE HAVING PROTECTIVE HOOD

FIELD AND BACKGROUND OF THE INVENTION

This invention relates in general to breathing masks and, in particular, to a new and useful escape filter device with a protective hood made of a transparent foil and including an externally attached strap.

DESCRIPTION OF THE PRIOR ART

We hear over and over again that people burn to death in fires, in hotels, for example, or are gravely or even fatally injured when jumping from a window in panic because they are afraid to run into fire gases without a respirator. Simple escape devices with filters, ready at hand, that may be donned by the unskilled user would facilitate rescue. A prerequisite, however, is that these escape filters fulfull their protective function for all head sizes, including people who wear eyeglasses, and those persons with beards, sideburns, moustaches, etc.

A respirator hood is known which consists of a transparent sack to be pulled over the head and which has a narrowing at the neck to which a gas filter is attached. At its slip-in portion, the sack is provided with a reinforcement band through which a cord is pulled in serpentine form, so that the sack cuffed over the head can be tied at the neck. The sack is further provided with an annular band possibly consisting of elastically flexible material, which extends under the chin and approximately over the skull cap and serves to keep the harmful space present in the sack as small as possible. With this known respirator hood there is the danger that the band will slip off, or that with a band thus arranged, the dead space inside the hood around the wearer's head is not sufficiently eliminated. This is necessary, however, as the exhaled air is otherwise not sufficiently eliminated in respiration (Swiss Pat. No. 193,779).

Another known respirator hood, particularly for persons with a head injury, comprises a very thin, transparent plastic foil, which applies on the head at the desired points. For this purpose, straps extending crosswise over the back of the head are fastened on the outside of the hood on both sides above and below the temples. The front portion of the hood is conical. In this portion, a connecting piece is bound in, which carries an inhaling valve and an exhaling valve. The inhaled air flows over two filters secured to a T-piece, through an accordion tube to the inlet valve of the connecting piece. A spacer is also bound in, together with the connecting piece. The latter has the form of a cuff, conically widening toward the inside of the hood with the cuff applying on the face over the mouth and nose in the manner of an inner half-mask. Due to the unattainable safe seal of the cuff at the mouth and nose portion, such a seal is not possible at all with the respirator hood in view of the different head forms and sizes, and thus, a part of the exhaled air gets into the remaining dead space inside of the respirator hood. Because scavenging is not possible, this part of the exhaled air is breathed in again. This is harmful, owing to the low $O_2$ and high $CO_2$ content of the exhaled air (German Pat. No. 1,199,620).

SUMMARY OF THE INVENTION

The present invention provides a hood with a breathing device which is constructed so as to avoid the disadvantages which result from insufficient scavenging of the respirator hood and also provides a light escape filter device with a protective hood which ensures, in any event, safe respiratory air conditions and also is suitable for use with eyeglasses, by persons with beards, etc., and for all head sizes.

This problem is solved, according to the invention, in that the respiratory connecting piece of the filter uptake of the externally arranged respiratory filter is passed through the material of the protective hood and terminates in a mouthpiece for the wearer, and the protective hood possesses internally, opposite the region of the upper lip, a nose pad, for which a strap fastened to the outside of the protective hood is provided which extends around the hood and can be tied in the back of the neck.

The particular advantages attained by the invention are that, as known from other escape filter devices, inhalation occurs directly through the filter and the respiratory connection with the mouthpiece, and exhalation occurs through the exhaling valve. This assures in the simplest manner that all sealing problems for the protective hood are avoided. The necessary nose closure occurs by a nose pad provided to fit on the respiratory connecting piece. It is so large, and also soft, that when tightening the strap fastened on the outside of the protective hood, it closes the nose without particular molestation to the wearer and without special manipulation. In addition, even a moustache on the upper lip does not interfere with the operation of the device. The solution is very simple and safe, especially as it can be applied even after drawing several breaths under the protective hood. The protective hood of transparent foil, due to the open vision and the soft material, does not give the sensation of being locked in, which is important for persons unfamiliar with respirators, as in the intended application of the device of the invention. The protective hood of soft foil material can be simply folded up around the filter or applied against it. Thus, the escape filter device can be easily stored as a compact unit. By using a heat-resistant, non-flammable protective hood material, the possible uses of the device are expanded. This is particularly true when the respiratory filter is a CO filter.

As a variation, the filter uptake may have an exhaling valve outside the protective hood. This is an advantage when using filters of higher output, as for example, the CO filter.

The CO filter is closed outside the inlet by a removable covering and inside the mouthpiece by a plug fastened to the folded protective hood. By this simple solution, it is assured that the filter is in any case open inside before the protective hood is put on. Even in panic, one cannot forget to open the filter. The covering at the inlet is pointed out to the wearer in any event since the wearer cannot inhale if it is closed. The wearer can remove the covering also with the protective hood applied and the mouthpiece inserted.

Accordingly, it is an object of the invention to provide an improved escape filter device for engagement over the head of a wearer which comprises a protective hood made of a transparent foil which is engageable on the wearer's head and has an opening in an area adapted to overlie the wearer's mouth and which includes an external strap fixed to the hood and extending around the front of the hood above the mouth area and below the area of the wearer's nose and which further includes a respiratory filter arranged outside the hood and having an air passage with an air connecting piece adapted to extend through the opening of the protective hood to the inside and which terminates in a mouthpiece for the wearer, and wherein, the hood has internally, opposite the region of the upper lip of the wearer, a nose pad which underlies the strap so that the strap may be tightened around the neck to cause the nose pad to engage under the nose of the wearer.

A further object of the invention is to provide an escape filter device having a protective hood which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

DESCRIPTION OF THE PREFERRED EMBODIMENT

Figure 1:
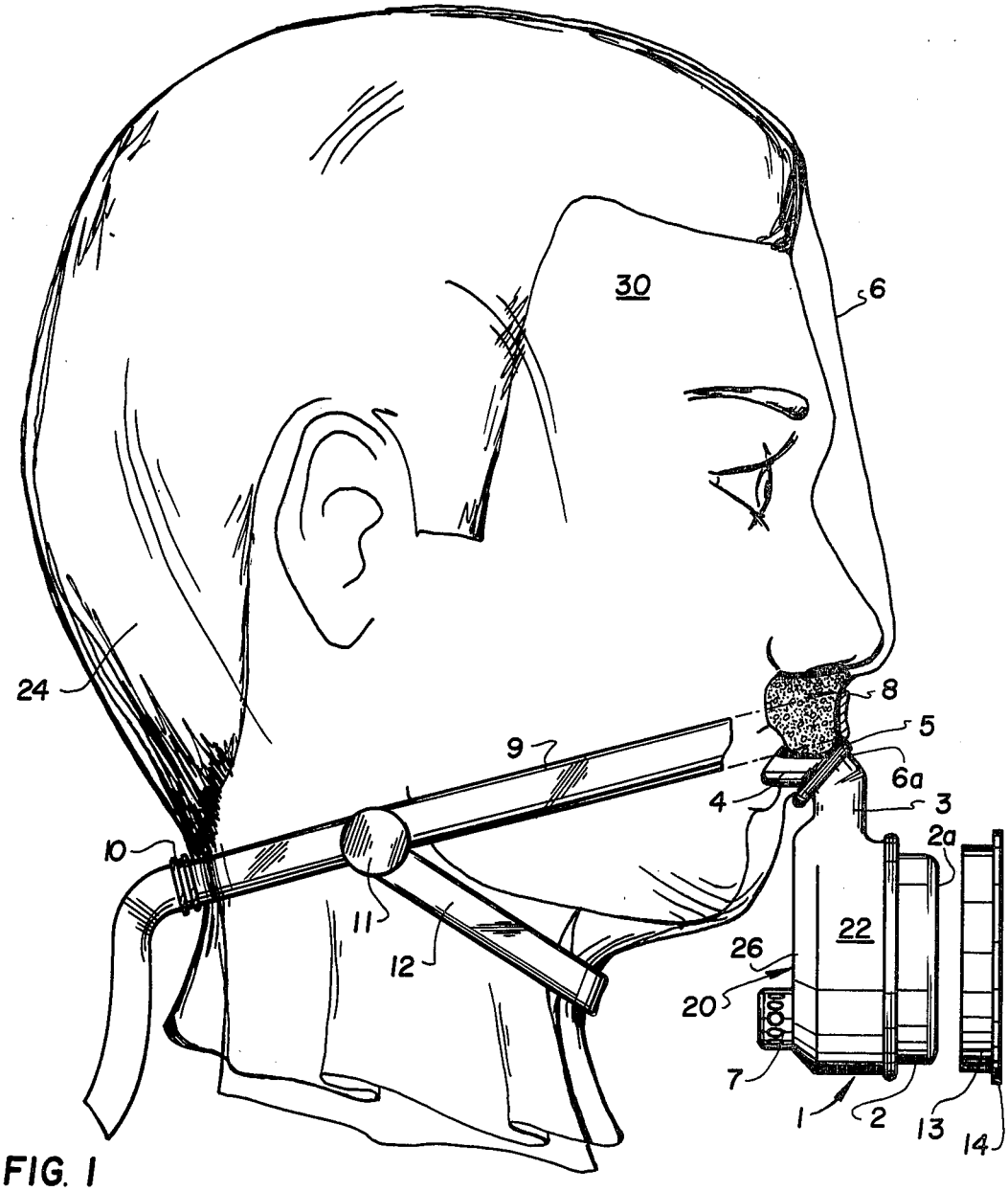
FIG. 1 is a schematic view of an emergency breathing device, constructed in accordance with the invention.

Referring to the drawings in particular, the invention embodied therein in FIG. 1, comprises an emergency breathing apparatus which includes a protective hood 6 and an air filter 20 having a mouthpiece 4 which is adapted to engage in an opening 6*a* of the hood which is aligned with the mouth of a wearer 30.

The filter 20 has a housing 1 comprising, for example, a rubber-elastic material, containing the respiratory filter 2 having an inlet 2*a*. The filter housing 1 includes an inflow passage portion 22 which terminates at the top with an offset part 3 forming a respiratory connecting piece which ends in a mouthpiece 4 which may be received in the mouth of a wearer 24. A sealing ring 5 engaged with the respiratory connecting piece 3 traverses a protective hood 6 and provides a seal for the mouthpiece 4. The filter housing 1 also has an exhaling passage portion 26 terminating in an exhaling valve 7.

A nose pad 8 is secured to the inside of the protective hood 6, above the respiratory connecting piece 3, opposite the region of the upper lip of the wearer 24. It is dimensioned so that it corresponds at least to the maximum distance between the connecting piece 3 and the wearer's nose opening. The material for the nose pad 8 is very elastic and gas-tight.

On the outside of the hood, above the nose pad 8, the strap 9 is fastened, which is adapted to extend around the jaw and lower neck of the wearer 24. The strap 9 is tied, e.g., with a knot or a buckle 10, pulled together in the back of the neck. In so doing, the nose pad 8 becomes compressed and this deformation will press the pad against the nostrils to close them.

In order that the protective hood will be closed sufficiently also at the throat portion, a chin band may be guided from an attachment point 11 at strap 9 at the juncture of the jaw and neck area which together with the closing by the knot 10 is pulled tight so that the protective hood 6 is substantially shut off in the throat-neck portion from the penetration of fire gases or the action of flames. Thus, for example, fire gases are kept away from the eyes. In the head-neck portion of the wearer, the protective hood 6 is dimensioned amply enough to fit any head shape, any hairdo, including beards, sideburns, etc. and so that it can be easily pulled over the head.

Figure 2:
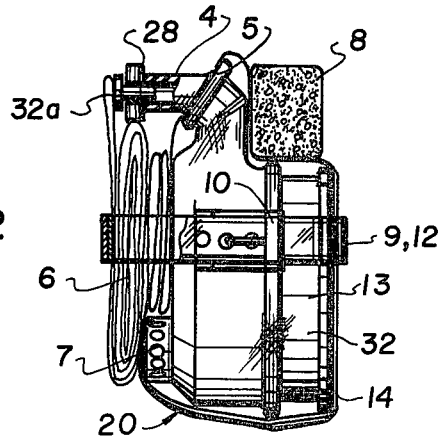
FIG. 2 is a side elevational view of a mask folded to show the mouthpiece plug carrying case, constructed in accordance with the invention.

A plug 28 shown in FIG. 2 is inserted into the respiratory filter mouthpiece to close it in the state of readiness with the protective hood folded up. The filter inlet 2*a* is closed by the cover 13. When using the filter device, the cover 13 is thrown away. It is provided with a lop or flap 14 providing an engagement lip whereby easy and rapid removal is possible.

As shown in FIG. 2, the emergency breathing apparatus may be contained in a carrying case 32 formed of the hood 6 and having straps 9 and 12 with a buckle 10 so that it may be tightened around the filter 20 which is positioned therein. The plug 28 is secured to a back wall portion 32*a* of the hood 6 so that when the filter 20 is taken out of the hood 6, the plug is immediately withdrawn from the opening of the mouthpiece 4. In the construction shown, the ring 5 is secured permanently to the hood 6 and the mouthpiece 4 may advantageously be one in which it may be connected to or separated from the ring 5.

While a specific embodiment of the invention has been shown and described in detail to illustrate the application of the principles of the invention, it will be understood that the invention may be embodied otherwise without departing from such principles.

What is claimed is:

1. An escape filter device, for engagement over the head of a wearer, comprising a protective hood made of a transparent foil material engageable on the wearer's head and having an opening in an area adapted to overlie the wearer's mouth, an external strap fixed to said hood and extending around the front of the hood over the mouth area and below the area of the wearer's nose, a respiratory filter arranged outside the hood and having an air passage connecting piece extending through the opening of said protective hood to the inside and terminating in the mouthpiece adapted to engage in the mouth of the wearer, a nose pad carried by said hood on its interior directly adjacent the opening in a position disposed below the nose of the wearer and underlying said strap, said strap having ends external of said hood which may be placed around said hood and tied in the back of the wearer's neck, whereby, to compress said nose pad into engagement with the wearer's nose.

2. An escape filter device, according to claim 1, wherein said protective hood is made of a heat-resistant, non-flammable material.

3. An escape filter device, according to claim 1, wherein said filter includes an exhaling valve located outside of said protective hood.

4. An escape filter device, according to claim 1, wherein said air filter comprises a carbon monoxide filter.

5. An escape filter device, according to claim 1, including a plug secured in the mouthpiece of said filter and means for automatically removing said plug prior to its insertion on the head of a wearer.

6. An escape filter device, according to claim 5, wherein said hood constitutes a casing for containing said filter when not in use, said hood having a backwall wall connected to said plug, said plug being retained by said back wall when said filter is removed therefrom.

* * * * *